United States Patent [19]

Shindo et al.

[11] Patent Number: 4,857,154

[45] Date of Patent: Aug. 15, 1989

[54] METHOD FOR PRODUCING A ZN-SERIES ELECTROPLATED STEEL SHEET

[75] Inventors: Yoshio Shindo; Fumio Yamazaki; Kouichi Wada; Hidehiro Tomio; Katsushi Saito, all of Kimitsu, Japan

[73] Assignee: Nippon Steel Corporation, Tokyo, Japan

[21] Appl. No.: 68,108

[22] Filed: Jun. 29, 1987

[30] Foreign Application Priority Data

| | | | |
|---|---|---|---|
| Jun. 30, 1986 | [JP] | Japan | 61-153331 |
| Jun. 30, 1986 | [JP] | Japan | 61-153333 |
| Jun. 30, 1986 | [JP] | Japan | 61-153334 |
| Jul. 4, 1986 | [JP] | Japan | 61-157603 |

[51] Int. Cl.[4] ..... C25D 5/48

[52] U.S. Cl. ..... 204/27; 204/29; 204/32.1; 204/35.1

[58] Field of Search ..... 204/29, 35.1, 32.1, 204/34, 27, 28

[56] References Cited

U.S. PATENT DOCUMENTS

| | | | |
|---|---|---|---|
| 4,075,066 | 2/1978 | Eckles et al. | 204/55 R |
| 4,160,707 | 7/1979 | Helle et al. | 204/37 R |
| 4,222,828 | 9/1980 | Zuurdeeg | 204/16 |

*Primary Examiner*—John F. Niebling
*Assistant Examiner*—William T. Leader
*Attorney, Agent, or Firm*—Kenyon & Kenyon

[57] ABSTRACT

A method for producing a steel sheet electroplated with a Zn-series alloy or Zn-series composite material, comprising, using an identical plating liquid, forming an initial electroplated layer in an amount essentially smaller than a subsequent main plating layer: relieving an electrodeposition strain in the initial electroplated layer after or during the formation thereof, and forming the main plating layer on the initial electroplated layer essentially free of the electrodeposition strain, thereby improving a plating adherence of the electroplated layer of Zn-series alloy or Zn-series composite material.

3 Claims, 1 Drawing Sheet

METHOD FOR PRODUCING A ZN-SERIES ELECTROPLATED STEEL SHEET

BACKGROUND OF THE INVENTION

1. Field of the Invention

The present invention relates to a method for producing steel material having a Zn series electroplated layer thereon. More particularly, the present invention relates to a method for producing an electroplated steel sheet provided with the above mentioned layer for an anti-corrosive protection of an automobile.

2. Description of the Related Arts

The de-icing rock salt sprayed on roads in arctic districts in the winter causes corrosion of an automobile body, and the use of various plated steel sheets for an automobile body has been considered as a corrosion control measure. The corrosion of the outer surface of an automobile body is promoted by the gravel, sprayed rock salt and the like which are thrown up from the road surface and impinge on the automobiles traveling on a road (this impingement is referred to as chipping) at a speed equal to the running speed of the automobiles, i.e., from 50 to 150 km/hour. The resultant impingement force is very high, and thus the paint coating on the automobile body may peel off or flaws reaching the steel substrate may be formed. Water from melted snow or the salt in the de-icing material will seep into the peeled parts or flaws and exert a detrimental corrosive action on the steel substrate. Accordingly, for example, Zn plated steel sheets have been employed as a corrosion control counter measure, since the Zn plating has a strong sacrificial anode effect and thus can satisfactorily protect the steel sheet from corrosion, even though the flaws reach the steel sheet. However, when a coating of paint is applied on the Zn plated layer, as in the case of an automobile outer panel, the paint bulging referred to as blistering sometimes forms in the paint coating.

The corrosive environments to which the steel sheets of an automobile are exposed make it necessary to provide uncoated steel sheets with a corrosion resistance, and in addition, a corrosion resistance after coating, including blister resistance, water adherence resistance, red rust resistance, and flow rust resistance.

These corrosion resistances, which are improved by the Zn plated steel sheets, are further improved by a Zn-series alloy layer, such as a plated layer of Zn-Ni, Zn-Fe, Zn-Co, Zn-Fe-Cr, Zn-Ni-Co, Zn-Cr, Zn-Mn, Zn-Ti, Zn-Sn, Zn-Cu, Zn-Cd, Zn-Pb, and the like, a multilayer plated steel having a plurality of layers of the above alloys (i.e., superimposed plated layers of different compositions), a steel sheet with a graded plating layer (i.e., composition of a plated layer varies along the thickness of the layer), and a steel sheet with a composite electroplated layer(s) (i.e., particles of oxide, such as $SiO_2$, $TiO_2$, $Al_2O_3$, and the like, as well as metallic particles of Zn, Al, Cr, and the like are incorporated in the Zn plated layer. Regarding the composite electroplated layer, Japanese examined Patent Publication No. 60-38480 discloses a Zn-oxide sol composite, Japanese Unexamined Patent Publication No. 60-141,898 discloses a Zn series alloy-oxide composite, and Japanese Unexamined Patent Publication No. 60-96786 discloses Zn-corrosion inhibiting pigments, such as $BaCrO_4$. The composite plating with nonmetallic particles is disclosed in Japanese Unexamined Patent Publication No. 61-64899. However, the particles precipitated and dispersed in the Zn or Zn alloy matrix are difficult to dissolve in the acidic solution and have a size which is not easily soluble.

The above described Zn-series electroplatings of Zn alloy and Zn composite material (hereinafter collectively referred to as the Zn-series electroplating) have problems, as explained in detail below, in that, the internal stress of the Zn series-alloy plated sheets is higher than that of the ordinary electroplated steel sheet of Zn alone. The adherence of the former plated layer with the steel substrate is disadvantageously inferior to that of the latter plated layer. Generally, the outer surface of an automobile body has a three-layer paint coating approximately 100 μm in total thickness and comprised of the cationic ED paint, the intercoat, and the top coat. The shrinkage stress generated during the baking of these coats has an affect on the plated layers, in that the post-coat substrate adherence is inferior to the unpainted adherence. Since the ambient temperature falls to around −50° C., shrinkage of the paint coating occurs and multiplies the stress acting on the plated layer(s). Note, in the three layer-coating, there is a drastic lowering of the substrate adherence upon a fall in the temperature. When chipping occurs in a plated layer(s) exhibiting a lowered plating adherence, the plated layer(s) of the Zn series-alloy plated steel sheets is disadvantageously peeled off. The plating adherence can be improved by interposing a covering layer consisting of one or more of Cr, Mn, Fe, Co, Ni, Cu, In, Zn, Cd, Sn, and Pb between the steel substrate and the Zn series-alloy plated layer, as disclosed in Japanese Unexamined Patent Publication No. 59-200789. In this publication, however, the plating adherence is verified under an extrusion formation (5 mm Erichsen bulging) of an unpainted article at an ordinary temperature, i.e., a mild condition. Tetsu to Hagane (Bulletin of Iron and Steel Institute of Japan) 71 (1985), page 1273, discloses that a layer of one or more of Fe, Zn, Ni, Cu, and Sn interposed between the steel substrate and the Zn series-alloy plated layer provides a satisfactory plating adherence under the conditions of two coating layers, under the icing point, and in a Dupont impact test. However, the present inventors confirmed that the plating adherence of a Zn-series electroplating provided by the above method is unsatisfactory under the severe conditions found in arctic regions (−50° C.), three-layer coating, and a high speed chipping. Furthermore, in the above described method for plating two different layers, at least two kinds of plating baths are necessary, which is not advantageous in the light of the production cost and control.

SUMMARY OF THE PRESENT INVENTION

The present inventors carried out research into and experiments inolving various plating methods using a single bath, in order to improve the plating adherence of the Zn-series electroplated steel sheets for automotive use having a three layer-coating thereon, so that the plating exhibits a good adherence even when subjected to chipping at a low temperature.

As a result, the present inventors confirmed that, in order to improve the plating adherence of a Zn-series electroplated layer, a great strain (internal strain) of electrodeposition, which is peculiar in the Zn-series electroplating, should be decreased. It was also confirmed that, when the electrodeposition strain of a plating layer formed at an initial period in the vicinity of a steel sheet is relaxed, then the plating adherence of the main plating layer deposited on the initial plating layer is improved. According to the discoveries by the present inventors, the following four methods are effective for improving the plating adherence.

A method for carrying out the following treatment in the identical plating liquid for a Zn-series electroplating: applying a Zn-series electroplated layer in a small amount, then immersing without current conduction, and subsequently applying the Zn-series electroplated layer until a determined plating amount is obtained.

A method for carrying out the following treatments in the identical plating liquid for a Zn-series electroplated layer: applying a Zn-series electroplated layer in a small amount then anodically electrolyzing the plated layer, and subsequently, applying the Zn-series electroplated layer until a determined plating amount is obtained.

A method for carrying out the following treatments in the identical plating liquid for a Zn-series-electroplated layer: applying a Zn-series electroplated layer in a small amount by using a pulse current as the plating current, and subsequently, applying the Zn-series electroplated layer by using a direct current until a predetermined plating amount is obtained.

A method for carrying out the following treatments in the identical plating liquid for Zn-series electroplated layer: first cathodically electrolyzing under a high current density and a small amount of the current conduction, and subsequently applying a Zn-series electroplated layer until a determined amount of plating is obtained.

According to the first method, the initial Zn-series electroplated layer applied is immersed in the plating solution without current conduction, with the result that a part of the Zn-series electroplated layer is dissolved, and further, a great electrodeposition strain, which is peculiar in the Zn-series electroplating, is drastically relaxed. This is turn leads to an improvement in the plating adherence of the entire plating layer, even though a subsequent electroplating of the upper layer is done by an ordinary method until a determined plating thickness is obtained.

According to the second method, the initially applied Zn-series electroplated layer in a small amount is dissolved partly by anodic electrolysis, and the plating adherence is improved as described for the first method.

According to the third method using a pulse current, the electrodeposition strain of a plating layer, which is deposited in a minute amount during the period of current-on time, is relaxed during the subsequent period of current-off time. In this process with the use of pulse current, the electrodeposition and relaxation of electrodeposition strain are repeated in a very small cycle, with the result that the strain in a Zn-series electroplated layer is drastically decreased. In this regard, since the plating adherence is improved by relaxing the electrodeposition strain of an initial plating layer, the pulse current may be applied to only the plating of an initial layer, but does not need to be applied to the entire thickness of the plating layer. The results described for the first method can be obtained, and in the subsequent electroplating, direct current is used.

According to the fourth method, the surface of a steel sheet cleaned by a plating pretreatment is subjected to cathodic electrolysis in the plating liquid, under a high current density and a small amount of current conduction. This cathodic electrolysis is accompanied by a violent generation of hydrogen gas, which completely removes any thin oxide film and diffusion concentrated layer remaining on the surface of a steel sheet, thereby activating the surface of a steel sheet. At the same time, initial plating deposits, which exhibit only a small electrodeposition strain, are formed on the surface of a steel sheet, in a small amount, and in the form of spots dispersed thereon. These initial plating deposits function as initial nuclei for crystallizing during the subsequent deposition of a Zn-series electroplated layer. The cathodic treatment under a high current density and small current conduction provides an activation of the surface of a steel sheet and simultaneous formation of the initial nuclei of crystallization with a small electrodeposition strain, which improves the plating adherence of a Zn-series electroplated layer.

The Zn-series electroplated steel sheet produced by the above methods has other properties, such as corrosion resistance and paint-adherence, comparable to those produced by the conventional methods.

The present invention was completed based on the above discoveries. In the general aspect, the present invention is related to the production of a Zn-series electroplated steel sheet and comprises, using an identical plating liquid, forming an initial electroplated layer in an amount essentially smaller than a subsequent main plating layer, relieving an electrodeposition strain in the initial electroplated layer after or during formation thereof, and forming the main plating layer on the initial electroplated layer essentially free of the electrodeposition strain, thereby improving a plating adherence of the electroplated layer of Zn-series alloy or Zn-series composite material.

The specific methods for relieving an electrodeposition strain are as follows.

(1) The Zn-series electroplated layer formed in the initial step is deposited in an amount of from 10 to 1000 $mg/m^2$ and the initial Zn-series electroplated layer is immersed in the plating liquid without the current conduction.

(2) The Zn-series electroplated layer formed in the initial step is deposited in an amount of from 10 to 1000 $mg/m^2$ and the initial Zn-series electroplated layer is anodically electrolyzed.

(3) The Zn-series electroplated layer formed in the initial step is deposited in an amount of from 10 to 1000 $mg/m^2$ by using a pulse current as the plating current.

(4) The steel sheet is cathodically electrolyzed at a high current density more than 300 $A/dm^2$ and at a current conduction of from 1 to 30 $Coulomb/dm^2$.

DESCRIPTION OF THE PREFERRED EMBODIMENTS

Figure 1A:
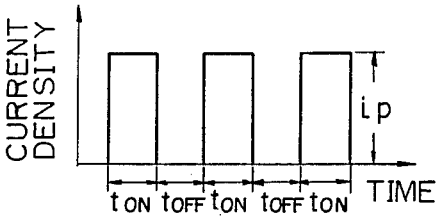
FIGS. 1A through F show the waveforms of the pulse current applicable to the present invention; and, FIG. 1G shows the waveform of the pulse current not applicable to the present invention.
Figure 1B:
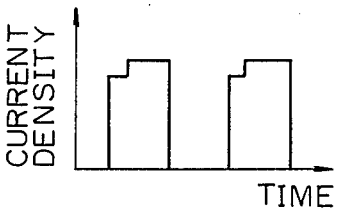
Figure 1C:
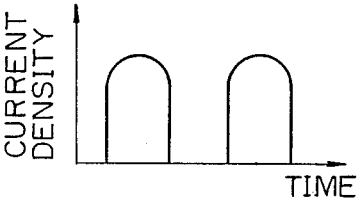
Figure 1D:
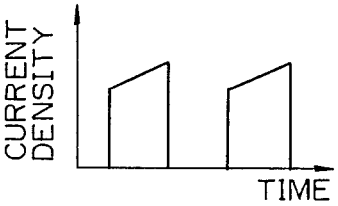
Figure 1E:
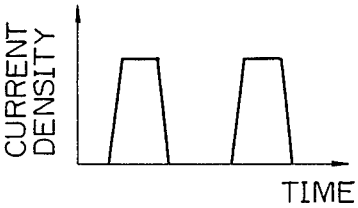
Figure 1F:
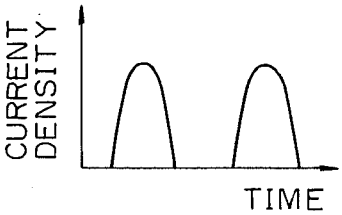

The above four methods are described hereinafter in detail.

Method 1

The initial Zn-series electroplated layer is deposited in an amount such that the steel sheet is covered with the layer to prevent a direct contact of the Zn-series electroplated layer, and further, the electrodeposition strain does not accumulate therein. A preferred deposition amount is from 10 to 1000 $mg/m^2$. When the deposition amount is less than 10 $mg/m^2$, the initial plating layer remaining after the immersion in the plating liquid is so small that the surface of a steel sheet may be partly exposed, thereby impairing the plating adherence. On the other hand, when the deposition amount is more than 1000 mg/m$^2$, the electrodeposition strain accumulates to an amount such that, in the initial Zn-series electroplated layer, it may not be relieved satisfactorily by the subsequent immersion in the plating liquid, thereby impairing the plating adherence. A more preferable amount of deposition of the initial Zn-series electroplated layer is in the range of from 10 to 500 mg/m$^2$, as in this range, an improved plating adherence is stably attained.

The initial Zn-series electroplated layer is preferably deposited in an amount of from 10 to 1000 mg/m$^2$ and is then immersed in the plating bath having the same composition as for the initial plating, under a state of a complete non-conduction of current, to relax the strain in the initial Zn-series electroplated layer. A preferred time for the immersion treatment depends on the plating bath, but is 0.5 second or longer in the case of a sulfuric-series bath of Zn-Ni alloy having a pH of from 0.5 to 2.5 and a bath temperature of from 30° to 70° C. An immersion treatment time of 1 second or longer is preferred for the total chloride-series plating bath of Zn-Ni alloy, having a pH of from 4 to 5 and bath temperature of from 50° to 60° C. A longer immersion time does not lower the effect of improving the plating adherence. An excessively long immersion time, however, decreases the remaining amount of the initial plating layer, such that surface of a steel sheet is partly exposed and thus the plating adherence becomes unsatisfactory. In addition, taking into consideration the factor that the productivity is decreased by prolonging the immersion time, the immersion time is desirably 10 seconds at longest.

The deposition amount of the main plating deposited in the second step is not specifically limited but is any required amount, usually in the range of from 10 to 100 g/m$^2$.

A series of steps according to the present invention, consisting of initial plating, immersion treatment, and main plating, is carried out continuously using a Zn-series electroplating liquid. Neither water rinsing nor drying need be carried out between the respective steps. The method according to the present invention is therefore advantageous in the light of plant-investment and production cost. The kinds of plating liquid are not specifically limited in any way, and may be the sulfate bath, total chloride bath, or mixture of these baths.

When implementing the production method according to the present invention by a continuous electroplating line having a number of plating cells, these can be utilized as follows:

(a) The first cell is used for the initial plating, the second cell is filled with the plating liquid and is used for immersion treatment of workpiece while passing therethrough, and the third or subsequent cell(s) is used for the main plating.

(b) A separate cell is interposed between the first and second cells and is used exclusively for immersion.

The current density of the initial and main plating is not limited. However, in the light of productivity, a preferred current density for both the initial plating and main plating is 20 A/dm$^2$.

Method 2

The initial Zn-series electroplated layer is deposited in an amount such that the steel sheet is covered with the layer to prevent a direct contact of the Zn-series electroplated layer, and further, the electrodeposition strain does not accumulate therein. A preferred deposition amount is from 10 to 1000 mg/m$^2$. When the deposition amount is less than 10 mg/m$^2$, the initial plating layer remaining after the immersion in the plating liquid is so small that the surface of a steel sheet may be partly exposed, thereby impairing the plating adherence. On the other hand, when the deposition amount is more than 1000 mg/m$^2$, the electrodeposition strain accumulates to an amount such that, in the initial Zn-series electroplated layer, it may not be relieved satisfactorily by the subsequent immersion in the plating liquid, thereby impairing the plating adherence. A more preferable amount of deposition of the initial Zn-series electroplated layer is in the range of from 10 to 500 mg/m$^2$, as in this range, an improved plating adherence is stably attained.

In the second method, the initial plated layer is subjected to anodic electrolysis in the plating liquid having the same composition as that for forming the initial plating, thereby relaxing the electrodeposition strain of the initial plating. The amount of current conduction in the anodic electrolyzing treatment is such that the electrodeposition strain is relaxed satisfactorily but the initial plating remains, to ensure a complete coverage of the steel sheet surface by the remaining initial plating layer. A preferred amount of current conduction is from 1 to 10 Coulomb/m$^2$ per 10 mg/m$^2$ of the initial plating. At an amount of current conduction of less than 1 Coulomb/m$^2$, the electrodeposition strain may not be relaxed satisfactorily, thereby attaining only an unsatisfactory effect of improving a plating adherence of the main plating. On the other hand, when the amount of current conduction is more than 10 Coulomb/m$^2$, the initial plating may expose a part of the surface of a steel sheet, thereby degrading the plating adherence of main plating. The current density of the anodic electrolysis is not specifiaally limited, but may be controlled, for example, in the continuous electroplating line, in accordance with the line speed, to provide the amount of current conduction as described above.

The initial plating, the main plating, and the steps of the second method are as described in the first method. The preferred parameters of the first method are, therefore, applicable also to the second method. In addition, the second method can be carried out in a continuous electroplating line as described in the first method.

Method 3

The initial Zn-series electroplated layer deposited by using a pulse current is preferably from 10 to 1000 mg/m$^2$. When the deposition amount is less than from 10 mg/m$^2$, the plating adherence of main plating may be unsatisfactory. On the other hand, when the deposition amount is more than 1000 mg/m$^2$, the plating adherence is not adversely influenced but the plating time becomes long or the pulse current becomes high. In this case, when a high speed continuous plating line is used, a pulse current source having a large capacity becomes necessary and, therefore, the disadvantages of adverse investment and production costs arise. The third method is hereinafter described with reference to the drawings.

Figure 1G:
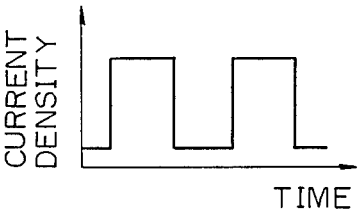

In the drawings, "$t_{on}$" is the current-on time, "$t_{off}$" is the current-off time, and "$i_p$" is the pulse-current density. The so-called rectangular wave as shown in FIG. 1A is most preferable in the light of ease of control, but is not limited thereto. Any waveforms such as shown in FIGS. 1B through F may be used. Waveforms other than those shown in the drawings may be used, but this is not advantageous because of the complicated control necessary for the plating current. Note, the current must be completely zero during the current-off time. The waveform such as shown in FIG. 1G with the current densities having two levels should not be used. The length of the current-off time is such that the electrodeposition strain of a plating layer deposited during the preceding current-on time is relieved. Desirably, the current-off time is 1 msec or longer. The current density of the pulse is not limited and may be below the critical level where plating burning occurs. Generally, since when plating with the pulse current the concentration of metal ions in the vicinity of plating surface is restored, during the current-off time, toward the concentration at the bulk of the plating bath, the critical level mentioned above is higher than in the case of plating with direct current. The current density of pulse therefore may be high, although this depends upon the length of the current-off time. A preferred current density, also taking into consideration the productivity, is preferably from 50 to 1000 A/dm$^2$ at the current-off time of 1 msec or more.

The main plating is carried out under the direct current, as usual.

The amount and current density of the main plating, as well as the series of steps according to the present invention and the kind of baths, are as described in the first method.

Method 4

In the fourth method, the surface of a steel sheet which has been pretreated by the ordinary pretreating method of electroplating is subjected to a cathodic electrolysis in the Zn-series electroplating solution, under a high current density and small amount of current conduction such that the ordinary cathodic deposition of plating does not occur but the generation of hydrogen gas at the cathode (workpiece) is predominant, and the plating deposition forms only the initial nuclei of plating. A preferred current density is 300 A/dm$^2$ or more. Below this current density, the predominant electrolysis phenomenon is plating deposition, with the result that the activation of steel sheet surface may not satisfactorily improve the plating adherence. The upper limit of current density is not specifically limited, except for the limitation of the capacity of the rectifier. A preferred amount of current conduction is from 1 to 30 Coulomb/dm$^2$, the amount of hydrogen gas-generation may be too small to satisfactorily activate the steel sheet surface, and to generate initial deposits which act as the nuclei of initial crystallization. Above the current-conduction amount exceeding 30 Coulomb/dm$^2$, the initial deposits may undergo plating burning and lose effectiveness as the nuclei of initial crystallization. A more preferred amount of the current conduction is from 1 to 20 Coulomb/dm$^2$. Within this range, the plating adherence is stably improved. In the fourth method, the steps of initial plating, cathodic electrolysis, and main plating should be carried out continuously using a plating liquid having an identical composition. This is outstandingly advantageous compared with the two-layer plating of different metals, in the light of investment cost and production cost. Note, if water-rinsing is interposed between the cathodic electrolysis and the Zn-series electroplating, the improvement in plating adherence is not attained. The kinds of plating baths are as described in the first method.

As described above, the most characterizing feature of present invention resides a relaxation of electrodeposition strain in the initial plating of the Zn-series electroplated layer and in a continuous treatment using an identical plating liquid, without the intermediary of water-rinsing and the like, thereby improving the plating adherence of the entire plating layer.

The Zn-series electroplated layers herein are a Zn-series alloy layer, multilayer, graded layer, and composite electroplated layer as described in the Description of the Related Arts (third paragraph). Further, the Zn-series electroplated layer may be a multi-layer of Zn-series alloy plating and Zn-series composite material plating. The plating adherence of these Zn-series electroplated layers is improved by the present invention. Evidently, the method according to the present invention need not be applied to both sides but may be applied to only one side of a steel sheet, in accordance with the intended application.

The present invention is hereinafter described by way of examples.

Various Zn-series electroplated steel sheets were produced by the methods of the present invention, and were then coated with a three-layer paint coating for automotive use. These steel sheets were subjected to a test of plating adherence under chipping at a low temperature. The plating liquid used was a sulfate bath having a pH of from 0.5 to 2.5 and a temperature of 30° to 70° C.

The paint-coating conditions, testing conditions, and evaluation criteria are given in Table 1.

The methods for producing Zn-series electroplated steel sheets and the results of evaluation of the plating adherence are given in Tables 2(1) through (4) Tables 2(1) through (4) correspond to examples of the first, second, third, and fourth methods, respectively.

In the examples, Nos. 1-1~22, 2-118 22, 3-1~22, and 4-1~24 are inventive examples of the Zn-series alloy electroplated layer, and Nos. 1-23~26, 2-23~26, 3-23~26, 4-25~28, are inventive examples of the Zn-series composite material plated layer. Nos. 1-27~31, 2-27~31, 3-27~31, and 4-29~32 are comparative samples, in which the inventive initial plating is not carried out. The samples Nos. 1-21 and 22, 2-21 and 22, 3-21 and 22, and 4-21~23 are inventive but the initial plating or treatment conditions do not fall within the preferred ranges according to the present invention.

The plating adherence attained in the comparative examples is poor or unsatisfactory but is improved in all of the inventive examples, irrespective of the composition of Zn-series electroplated layer.

TABLE 1

| | |
|---|---|
| Treatments of Samples | (1) Size of samples: 0.8 mm × 70 mm × 150 mm |
| | (2) Chemical conversion treatments: Dip type zinc phosphating |
| | (3) ED coating: cation type-film thickness 20μ |
| | (4) intermediate coating: alkyd type film thickness 40μ |
| | (5) top coating: melamine alkyd coating film thickness |

TABLE 1-continued

| | |
|---|---|
| | 40μ |
| Testing Method | Plating Adherence (Chipping test at low temperature) Samples, which have undergone the top coating treatment (5), are subjected to a chipping test at a low temperature |
| | (a) chips: 300 graves for road 5~10 g/piece |
| | (b) chipping: the above chips are impinged on samples cooled to −50° C. at a speed of 150 km/h by means of high pressure air. |
| Evaluation Criterion | (1) Adherence of plating Under above low temperature-chipping |
| | (a) no peeling of plating - 4 |
| | (b) peeling of plating at less than 1% of samples area - 3 |
| | (c) peeling of a plating less than from 1 to 3% of sample's surface area - 2 |
| | (d) peeling of plating at 3% or more of sample's surface area - 1 |

TABLE 2-1

| Sample Nos. | Initial Plating Current Density ($A/dm^2$) | Initial Plating Deposition Amount ($mg/m^2$) | Dipping Time (sec) | Main Plating Current Density ($A/dm^2$) | Main Plating Deposition Amount ($g/m^2$) | Plating Composition (except for Zn) | Evaluation of Plating Adherence |
|---|---|---|---|---|---|---|---|
| Invention | | | | | | | |
| 1-1 | 20 | 10 | 0.5 | 30 | 20 | 10% Ni | 4 |
| 2 | 30 | 50 | 1 | 50 | 20 | 12% Ni | 4 |
| 3 | 50 | 100 | 3 | 70 | 40 | 5% Ni | 4 |
| 4 | 70 | 500 | 5 | 100 | 20 | 8% Ni | 4 |
| 5 | 100 | 1000 | 10 | 150 | 40 | 15% Ni | 4 |
| 6 | 20 | 1000 | 5 | 30 | 20 | 15% Fe | 3 |
| 7 | 30 | 10 | 1 | 50 | 20 | 25% Fe | 4 |
| 8 | 50 | 500 | 10 | 70 | 40 | 10% Fe | 4 |
| 9 | 70 | 100 | 3 | 100 | 20 | 20% Fe | 4 |
| 10 | 100 | 50 | 5 | 150 | 40 | 30% Fe | 4 |
| 11 | 30 | 200 | 1 | 70 | 20 | 12% Ni—0.3% Co | 4 |
| 12 | 100 | 800 | 3 | 150 | 20 | 8% Ni—0.5% Co | 3 |
| 13 | 70 | 400 | 1 | 30 | 40 | 10% Ni—0.1% Co | 4 |
| 14 | 50 | 1000 | 3 | 100 | 20 | 5% Ni—0.3% Co | 4 |
| 15 | 20 | 600 | 5 | 50 | 40 | 15% Ni—0.1% Co | 4 |
| 16 | 50 | 400 | 5 | 150 | 20 | 12% Ni—0.5% Ti | 4 |
| 17 | 70 | 600 | 1 | 50 | 20 | 20% Fe—1% Cr | 3 |
| 18 | 100 | 1000 | 5 | 100 | 40 | 5% Co | 4 |
| 19 | 30 | 200 | 3 | 70 | 20 | 20% Mn | 4 |
| 20 | 20 | 800 | 3 | 30 | 40 | 10% Cu | 4 |
| 21 | 30 | 5 | 1 | 50 | 20 | 12% Ni | 3 |
| 22 | 70 | 1200 | 3 | 100 | 20 | 20% Fe | 3 |
| 23 | 70 | 100 | 3 | 100 | 20 | 11% Ni—3% $SiO_2$ | 4 |
| 24 | 50 | 10 | 1 | 50 | 20 | 11% Ni—3% $BaCrO_4$ | 4 |
| 25 | 30 | 1000 | 5 | 100 | 40 | 10% Ni—3% $Al_2O_3$ | 4 |
| 26 | 100 | 500 | 3 | 150 | 20 | 15% Fe—5% $SiO_2$ | 4 |
| Comparative | | | | | | | |
| 27 | — | — | — | 50 | 20 | 12% Ni | 1 |
| 28 | — | — | — | 100 | 20 | 20% Fe | 1 |
| 29 | — | — | — | 70 | 20 | 12% Ni—0.3% Co | 1 |
| 30 | — | — | — | 100 | 20 | 11% Ni—3% $SiO_2$ | 1 |
| 31 | — | — | — | 150 | 20 | 15% Fe—5% $SiO_2$ | 1 |

TABLE 2-2

| Sample Nos. | Initial Plating Current Density ($A/dm^2$) | Initial Plating Deposition Amount ($mg/m^2$) | Anodic Electrolysis Current Conduction Amount ($Coulomb/m^2$) | Main Plating Current Density ($A/dm^2$) | Main Plating Deposition Amount ($g/m^2$) | Plating Composition (except for Zn) | Evaluation of Plating Adherence |
|---|---|---|---|---|---|---|---|
| Invention | | | | | | | |
| 2-1 | 10 | 10 | 1 | 30 | 20 | 10% Ni | 4 |
| 2 | 30 | 50 | 50 | 50 | 20 | 12% Ni | 4 |
| 3 | 50 | 100 | 100 | 70 | 40 | 5% Ni | 4 |
| 4 | 70 | 500 | 50 | 100 | 20 | 8% Ni—1% Fe | 4 |
| 5 | 100 | 1000 | 1000 | 150 | 40 | 15% Ni | 3 |
| 6 | 30 | 10 | 5 | 30 | 20 | 15% Fe | 4 |
| 7 | 10 | 50 | 5 | 50 | 20 | 25% Fe | 4 |
| 8 | 70 | 100 | 50 | 70 | 40 | 10% Fe—1% Ni | 4 |
| 9 | 50 | 500 | 250 | 100 | 20 | 20% Fe | 4 |

TABLE 2-2-continued

| Sample Nos. | Initial Plating Current Density ($A/dm^2$) | Initial Plating Deposition Amount ($mg/m^2$) | Anodic Electrolysis Current Conduction Amount ($Coulomb/m^2$) | Main Plating Current Density ($A/dm^2$) | Main Plating Deposition Amount ($g/m^2$) | Plating Composition (except for Zn) | Evaluation of Plating Adherence |
|---|---|---|---|---|---|---|---|
| 10 | 100 | 1000 | 100 | 150 | 40 | 30% Fe | 3 |
| 11 | 50 | 10 | 10 | 70 | 20 | 12% Ni—0.3% Co | 4 |
| 12 | 70 | 100 | 10 | 150 | 20 | 8% Ni—0.5% Co | 4 |
| 13 | 100 | 1000 | 500 | 30 | 40 | 10% Ni—1% Fe—0.1% Cr | 4 |
| 14 | 30 | 50 | 25 | 100 | 20 | 5% Ni—0.3% Co | 4 |
| 15 | 10 | 500 | 500 | 50 | 40 | 15% Ni—0.1% Co | 4 |
| 16 | 20 | 20 | 10 | 150 | 20 | 12% Ni—0.5% Ti | 4 |
| 17 | 100 | 200 | 20 | 50 | 20 | 20% Fe—1% Cr | 4 |
| 18 | 40 | 400 | 40 | 100 | 40 | 5% Co | 4 |
| 19 | 80 | 600 | 30 | 70 | 20 | 20% Mn | 3 |
| 20 | 60 | 800 | 80 | 30 | 40 | 10% Cu | 4 |
| 21 | 30 | 5 | 5 | 50 | 20 | 12% Ni | 3 |
| 22 | 50 | 1200 | 600 | 100 | 20 | 20% Fe | 3 |
| 23 | 70 | 100 | 10 | 100 | 20 | 11% Ni—3% $SiO_2$ | 4 |
| 24 | 50 | 10 | 1 | 50 | 20 | 11% Ni—3% $BaCrO_4$ | 4 |
| 25 | 30 | 1000 | 100 | 100 | 40 | 10% Ni—3% $Al_2O_3$ | 4 |
| 26 | 100 | 500 | 50 | 150 | 20 | 15% Fe—5% $SiO_2$ | 4 |
| Comparative | | | | | | | |
| 27 | — | — | — | 50 | 20 | 12% Ni | 1 |
| 28 | — | — | — | 100 | 20 | 20% Fe | 1 |
| 29 | — | — | — | 70 | 20 | 12% Ni—0.3% Co | 1 |
| 30 | — | — | — | 100 | 20 | 11% Ni—3% $SiO_2$ | 1 |
| 31 | — | — | — | 150 | 20 | 15% Fe—5% $SiO_2$ | 1 |

TABLE 2-3

| Sample Nos. | Initial Plating (Pulse Current) Pulse Current Density ($A/dm^2$) | Initial Plating (Pulse Current) Current Off Time (msec) | Initial Plating (Pulse Current) Deposition Amount ($mg/m^2$) | Main Plating (DC) Current Density ($A/dm^2$) | Main Plating (DC) Deposition Amount ($g/m^2$) | Plating Composition (except for Zn) | Evaluation of Plating Adherence |
|---|---|---|---|---|---|---|---|
| Invention | | | | | | | |
| 3-1 | 50 | 1 | 10 | 30 | 20 | 10% Ni | 4 |
| 2 | 100 | 3 | 50 | 50 | 20 | 12% Ni | 4 |
| 3 | 300 | 5 | 100 | 70 | 40 | 5% Ni | 4 |
| 4 | 500 | 7 | 500 | 100 | 20 | 8% Ni—1% Fe | 4 |
| 5 | 1000 | 10 | 1000 | 150 | 40 | 15% Ni | 4 |
| 6 | 300 | 7 | 10 | 30 | 20 | 15% Fe | 4 |
| 7 | 100 | 5 | 50 | 50 | 20 | 25% Fe | 4 |
| 8 | 1000 | 3 | 100 | 70 | 40 | 10% Fe—1% Ni | 4 |
| 9 | 500 | 10 | 500 | 100 | 20 | 20% Fe | 4 |
| 10 | 50 | 1 | 1000 | 150 | 40 | 30% Fe | 4 |
| 11 | 1000 | 3 | 10 | 70 | 20 | 12% Ni—0.3% Co | 4 |
| 12 | 50 | 1 | 100 | 150 | 20 | 8% Ni—0.5% Co | 4 |
| 13 | 500 | 10 | 1000 | 30 | 40 | 10% Ni—1% Fe—0.1% Cr | 4 |
| 14 | 300 | 7 | 50 | 100 | 20 | 5% Ni—0.3% Co | 4 |
| 15 | 100 | 5 | 50 | 50 | 40 | 15% Ni—0.1% Co | 4 |
| 16 | 200 | 5 | 20 | 150 | 20 | 12% Ni—0.5% Ti | 4 |
| 17 | 600 | 3 | 20 | 50 | 20 | 20% Fe—1% Cr | 4 |
| 18 | 1000 | 1 | 400 | 100 | 40 | 5% Co | 4 |
| 19 | 400 | 10 | 600 | 70 | 20 | 20% Mn | 4 |
| 20 | 800 | 7 | 800 | 30 | 40 | 10% Cu | 4 |
| 21 | 100 | 3 | 5 | 50 | 20 | 12% Ni | 3 |
| 22 | 500 | 10 | 1200 | 100 | 20 | 20% Fe | 3 |
| 23 | 500 | 3 | 100 | 100 | 20 | 11% Ni—3% $SiO_2$ | 4 |
| 24 | 300 | 1 | 10 (15) | 50 | 20 | 11% Ni—3% $BaCrO_4$ | 4 |
| 25 | 100 | 10 | 1000 | 100 | 40 | 10% Ni—3% $Al_2O_3$ | 4 |
| 26 | 1000 | 5 | 500 | 150 | 20 | 15% Fe—5% $SiO_2$ | 4 |
| Comparative | | | | | | | |
| 27 | — | — | — | 50 | 20 | 12% Ni | 1 |
| 28 | — | — | — | 100 | 20 | 20% Fe | 1 |
| 29 | — | — | — | 70 | 20 | 12% Ni—0.3% Co | 1 |
| 30 | — | — | — | 100 | 20 | 11% Ni—3% $SiO_2$ | 1 |
| 31 | — | — | — | 150 | 20 | 15% Fe—5% $SiO_2$ | 1 |

TABLE 2-4

| Sample Nos. | Cathodic Electrolysis: Current Density ($A/dm^2$) | Cathodic Electrolysis: Current Conduction Amount ($Coulomb/dm^2$) | Main Plating: Current Density ($A/dm^2$) | Main Plating: Deposition Amount ($g/m^2$) | Plating Composition (except for Zn) | Evaluation of Plating Adherence |
|---|---|---|---|---|---|---|
| Invention | | | | | | |
| 4-1 | 300 | 1 | 30 | 20 | 10% Ni | 4 |
| 2 | 500 | 5 | 50 | 20 | 12% Ni | 4 |
| 3 | 400 | 10 | 70 | 40 | 5% Ni | 4 |
| 4 | 450 | 20 | 100 | 20 | 8% Ni—1% Fe | 4 |
| 5 | 350 | 30 | 150 | 40 | 15% Ni | 4 |
| 6 | 450 | 20 | 30 | 20 | 15% Fe | 4 |
| 7 | 400 | 5 | 50 | 20 | 25% Fe | 4 |
| 8 | 300 | 30 | 70 | 40 | 10% Fe—1% Ni | 4 |
| 9 | 500 | 1 | 100 | 20 | 20% Fe | 4 |
| 10 | 350 | 10 | 150 | 40 | 30% Fe | 4 |
| 11 | 300 | 5 | 70 | 20 | 12% Ni—0.3% Co | 4 |
| 12 | 400 | 10 | 150 | 20 | 8% Ni—0.5% Co | 4 |
| 13 | 500 | 1 | 30 | 40 | 10% Ni—1% Fe—0.1% Cr | 4 |
| 14 | 600 | 30 | 100 | 20 | 5% Ni—0.3% Co | 4 |
| 15 | 700 | 20 | 50 | 40 | 15% Ni—0.1% Co | 4 |
| 16 | 500 | 30 | 150 | 20 | 12% Ni—0.5% Ti | 4 |
| 17 | 700 | 20 | 50 | 20 | 20% Fe—1% Cr | 4 |
| 18 | 300 | 5 | 100 | 40 | 5% Co | 4 |
| 19 | 600 | 10 | 70 | 20 | 20% Mn | 4 |
| 20 | 400 | 1 | 30 | 40 | 10% Cu | 4 |
| 21 | 300 | 0.5 | 70 | 20 | 12% Ni—0.3% Co | 2 |
| 22 | 500 | 50 | 50 | 20 | 12% Ni | 2 |
| 23 | 250 | 1 | 100 | 20 | 20% Fe | 2 |
| 24 | 300 | 5 | 250 | 20 | 12% Ni—0.3% Co | 3 |
| 25 | 500 | 5 | 100 | 20 | 11% Ni—3% $SiO_2$ | 4 |
| 26 | 400 | 1 | 50 (15) | 20 | 11% Ni—3% $BaCrO_4$ | 4 |
| 27 | 300 | 30 | 100 | 40 | 10% Ni—3% $Al_2O_3$ | 4 |
| 28 | 700 | 10 | 150 | 20 | 15% Fe—5% $SiO_2$ | 4 |
| Comparative | | | | | | |
| 29 | — | — | 50 | 20 | 12% Ni | 1 |
| 30 | — | — | 100 | 20 | 20% Fe | 1 |
| 31 | — | — | 100 | 20 | 11% Ni—3% $SiO_2$ | 1 |
| 32 | — | — | 150 | 20 | 15% Fe—5% $SiO_2$ | 1 |

We claim:

1. A method for producing a coated steel sheet comprising the steps of: electrodepositing an initial layer of a zinc alloy or of a zinc alloy containing particles of a different material or metallic zinc containing particles of a different material, the initial layer being deposited in an amount of about 10–1000 mg/square meter; treating the initial layer in plating liquid identical in composition to that used to deposit the initial layer to dissolve part of the initial layer to relieve the electriodeposition strain of the initial layer, the amount dissolved being insufficient to result in the exposure of the surface of the steel sheet; and electrodepositing a main plating layer in plating liquid identical in composition to that used to deposit the initial layer, the main plating layer having a thickness substantially greater than that of the initial layer, thereby improving the adherence of the coating.

2. A method according to claim 1, wherein said treating of the initial layer in said plating liquid is carried out by immersing the initial layer in the plating liquid without plating-current conduction.

3. A method according to claim 1, wherein said treating of the initial layer in said plating liquid is carried out by subjecting the initial layer to anodic electrolysis in the plating liquid.

* * * * *